US006686814B2

(12) United States Patent
Chiu et al.

(10) Patent No.: US 6,686,814 B2
(45) Date of Patent: Feb. 3, 2004

(54) VOLTAGE TUNABLE VARACTORS AND TUNABLE DEVICES INCLUDING SUCH VARACTORS

(75) Inventors: Luna H. Chiu, Abingdon, MD (US); Yongfei Zhu, Columbia, MD (US); Xubai Zhang, Columbia, MD (US); Steven C. Stowell, Columbia, MD (US); Andrey Kozyrev, St. Petersburg (RU); Somnath Sengupta, Warwick, MD (US); Louise Sengupta, Warwick, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/223,745

(22) Filed: Aug. 19, 2002

(65) Prior Publication Data

US 2003/0001692 A1 Jan. 2, 2003

Related U.S. Application Data

(63) Continuation of application No. 09/419,126, filed on Oct. 15, 1999.

(60) Provisional application No. 60/104,504, filed on Oct. 16, 1998.

(51) Int. Cl.[7] ..... H01P 1/18

(52) U.S. Cl. ..... 333/164; 333/167; 333/174; 333/995; 361/311

(58) Field of Search ..... 333/174, 175, 333/167, 168, 176, 995, 164; 505/210; 361/311, 277

(56) References Cited

U.S. PATENT DOCUMENTS 4,598,424 A * 7/1986 Watanabe et al. ..... 455/327
5,032,805 A 7/1991 Elmer et al.
5,307,033 A 4/1994 Koscica et al.
5,472,935 A 12/1995 Yandrofski et al.
5,561,407 A 10/1996 Koscica et al.
5,640,042 A 6/1997 Koscica et al.
5,721,194 A 2/1998 Yandrofski et al.
5,760,661 A 6/1998 Cohn
6,096,127 A * 8/2000 Dimos et al. ..... 117/9
6,097,263 A 8/2000 Mueller et al.
6,377,440 B1 * 4/2002 Zhu et al. ..... 361/311

OTHER PUBLICATIONS

Prineton Scientific Corp, "Lanthanum Aluminate".*
Princeton Scientific Cop., Neodymium Gallate.*
Arthur R. Von Hippel, "Dielectric Material and Applications", 1959, The Technology Press, 305 and 306.*
Kozyrev et al., "Ferroelectric Films: Nonlinear Properties and Applications in Microwave Devices," *IEEE MTT–S Digest*, Jun. 7, 1998, pp. 985–988.
Gevorgian et al., "Electrically controlled HTSC/ferroelectric coplanar waveguide" *IEE Proc.–Microw. Antennas Propag.*, vol. 141, No. 6, Dec. 1994, pp. 501–503.
Patent Abstracts of Japan, vol. 8, No. 119, Jun. 5, 1984, JP 59033902A (Fujitsu K.K.), Feb. 24, 1984.

* cited by examiner

*Primary Examiner*—Robert Pascal
*Assistant Examiner*—Kimberly E Glenn
(74) *Attorney, Agent, or Firm*—Robert P. Lenart; Michael N. Haynes; James S. Finn

(57) ABSTRACT

A voltage tunable dielectric varactor includes a substrate having a low dielectric constant and having generally planar surface, a tunable ferroelectric layer positioned on the generally planar surface of the substrate, and first and second electrodes positioned on a surface of the tunable ferroelectric layer opposite the generally planar surface of the substrate. The first and second electrodes are separated to form a gap therebetween. The varactor includes an input for receiving a radio frequency signal and an output for delivering the radio frequency signal. A bias voltage applied to the electrodes changes the capacitance of the varactor between the input and output thereof. Phase shifters and filters that include the varactor are also described.

9 Claims, 6 Drawing Sheets

VOLTAGE TUNABLE VARACTORS AND TUNABLE DEVICES INCLUDING SUCH VARACTORS

CROSS REFERENCE TO RELATED PATENT APPLICATION

This application claims the benefit of U.S. Provisional Patent Application No. 60/104,504, filed Oct. 16, 1998.

This application is a continuation of a pending U.S. patent application titled "Voltage Tunable Varactors and Tunable Devices Including Such Varactors", Ser. No. 09/419,126, filed Oct. 15, 1999, which is incorporated by reference herein in its entirety.

BACKGROUND OF INVENTION

The present invention relates generally to room temperature voltage tunable varactors and tunable devices that include such varactors.

Phased array antennas are comprised of a large number of elements that emit phase controlled signals to form a radio beam. The radio signal can be electronically steered by the active manipulation of the relative phasing of the individual antenna elements. This electronic beam steering concept applies to both transmitters and receivers. Phased array antennas are advantageous in comparison to their mechanical counterparts with respect to their speed, accuracy, and reliability. The replacement of gimbal scanned antennas by their electronically scanned counterpart can provide more rapid and accurate target identification. Complex tracking exercises can also be performed rapidly and accurately with a phased array antenna system.

Adjustable phase shifters are used to steer the beam in phased array antennas. Previous patents in this area include ferroelectric phase shifters in U.S. Pat. Nos.: 5,307,033, 5,032,805, and 5,561,407. These phase shifters include one or more microstrip lines on a ferroelectric substrate as the phase modulate elements. The permittivity of the ferroelectric substrate may be varied by varying the strength of an electric field on the substrate. Tuning of the permittivity of the substrate results in phase shifting when an RF signal passes through the microstrip line. The microstrip ferroelectric phase shifters disclosed in those patents suffer high conductor losses and impedance matching problems due to the high dielectric constant of the ferroelectric substrates.

Future communications will employ wideband frequency-hopping techniques, so that large amount of digital data can be transferred over the band. A critical component for these applications is a low cost fast-acting tunable filter. Digital data could be distributed or encoded over a band of frequencies in a sequence determined by controlling circuitry of the tunable filter. This would allow several users to transmit and receive over a common range of frequencies.

Varactors can be used independently utilized or can be integrated into low cost tunable filters. These varactors and filters can be used at numerous frequency ranges, including frequencies above L-band, in a myriad of commercial and military applications. These applications include (a) L-band (1–2 GHz) tunable filters for wireless local area network systems, personal communications systems, and satellite communication systems, (b) C-band (4–6 GHz) varactors and tunable filter for frequency hopping for satellites communications and radar systems (c) X-band (9–12 GHz) varactors and filters for use in radar systems (d) $K_u$ band (12–18 GHz) for use in satellite television systems, and (e) $K_A$ band tunable filters for satellites communications.

Common varactors used today are Silicon and GaAs based diodes. The performance of these varactors is defined by the capacitance ratio, $C_{max}/C_{min}$, frequency range and figure of merit, or Q factor (1/tan δ) at the specified frequency range. The Q factors for these semiconductor varactors for frequencies up to 2 GHz are usually very good. However, at frequencies above 2 GHz, the Q factors of these varactors degrade rapidly. In fact, at 10 GHz the Q factors for these varactors are usually only about 30.

Varactors that utilize a thin film ferroelectric ceramic as a voltage tunable element in combination with a superconducting element have been described. For example, U.S. Pat. No. 5,640,042 discloses a thin film ferroelectric varactor having a carrier substrate layer, a high temperature superconducting layer deposited on the substrate, a thin film ferroelectric deposited on the metallic layer, and a plurality of metallic conductive means disposed on the thin film ferroelectric, which are placed in electrical contact with RF transmission lines in tuning devices. Another tunable capacitor using a ferroelectric element in combination with a superconducting element is disclosed in U.S. Pat. No. 5,721,194.

There is a need for varactors that can operate at temperatures above those necessary for superconduction and at frequencies up to 10 GHz and beyond, while maintaining high Q factors. In addition, there is a need for microwave devices that include such varactors.

SUMMARY OF INVENTION

A voltage tunable dielectric varactor includes a substrate having a first dielectric constant and having generally planar surface, a tunable ferroelectric layer positioned on the generally planar surface of the substrate, with the tunable ferroelectric layer having a second dielectric constant greater than the first dielectric constant, and first and second electrodes positioned on a surface of the tunable ferroelectric layer opposite the generally planar surface of the substrate. The first and second electrodes are separated to form a gap therebetween. A bias voltage applied to the electrodes changes the capacitance of the varactor between an input and an output thereof.

The invention also encompasses phase shifters that include the above varactors. One embodiment of such phase shifters includes a rat race coupler having an RF input and an RF output, first and second microstrips positioned on the rat race coupler, a first reflective termination positioned adjacent to an end of the first microstrip, and a second reflective termination positioned adjacent to an end of the second microstrip, wherein the first and second reflective terminations each includes one of the tunable varactors.

Another embodiment of such phase shifters includes a microstrip having an RF input and an RF output, first and second radial stubs extending from the microstrip, a first varactor positioned within the first radial stub, and a second varactor positioned within the second radial stub, wherein each of the first and second varactors is one of the above tunable varactors.

The planar ferroelectric varactors of the present invention can be used to produce a phase shift in various microwave devices, and in other devices such as tunable filters. The devices herein are unique in design and exhibit low insertion loss even at frequencies greater than 10 GHz. The devices utilize low loss tunable bulk or film dielectric elements.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENTS

Figure 1:
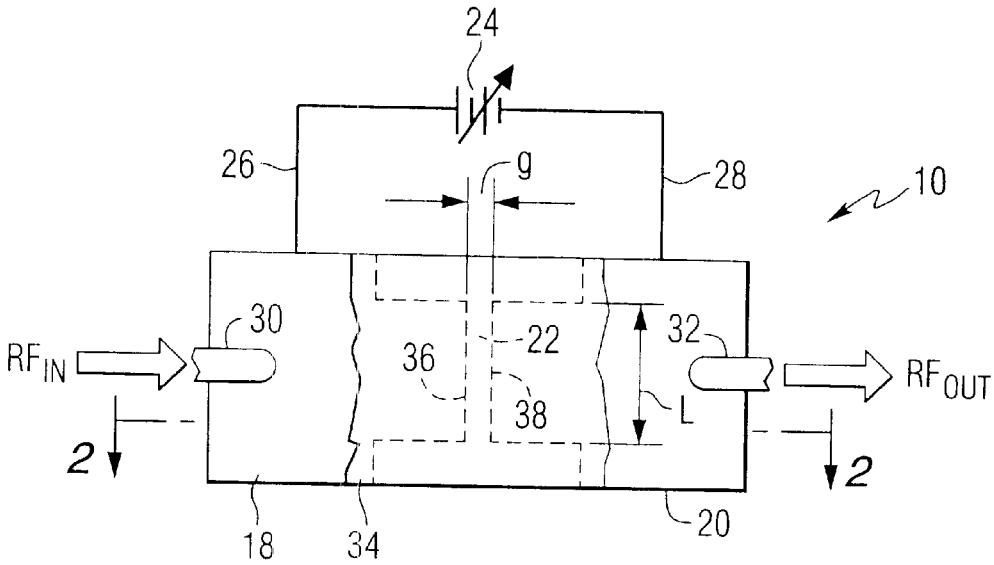
FIG. 1 is a top plan view of a planar voltage tunable dielectric varactor constructed in accordance with the present invention.
Figure 2:
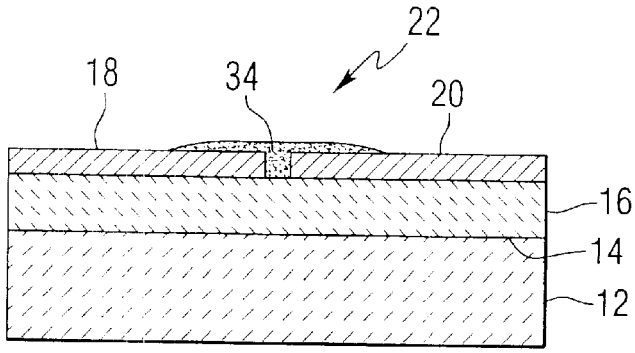
FIG. 2 is a cross-sectional view of the varactor of FIG. 1, taken along line 2—2.

Referring to the drawings, FIGS. 1 and 2 are top and cross sectional views of a varactor 10 constructed in accordance with this invention. The varactor 10 includes a substrate 12 having a generally planar top surface 14. A tunable ferroelectric layer 16 is positioned adjacent to the top surface of the substrate. A pair of metal electrodes 18 and 20 are positioned on top of the ferroelectric layer. The substrate 12 is comprised of a material having a relatively low permittivity such as MgO, Alumina, $LaAlO_3$, Sapphire, or a ceramic. For the purposes of this invention, a low permittivity is a permittivity of less than about 30. The tunable ferroelectric layer 16 is comprised of a material having a permittivity in a range from about 20 to about 2000, and having a tunability in the range from about 10% to about 80% at a bias voltage of about 10 V/$\mu$m. In the preferred embodiment this layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof. The tunable layer in one preferred embodiment has a dielectric permittivity greater than 100 when subjected to typical DC bias voltages, for example, voltages ranging from about 5 volts to about 300 volts. A gap 22 of width g, is formed between the electrodes 18 and 20. The gap width must be optimized to increase ratio of the maximum capacitance $C_{max}$ to the minimum capacitance $C_{min}$ ($C_{max}/C_{min}$) and increase the quality facto (Q) of the device. The width of this gap has the most influence on the varactor parameters. The optimal width, g, will be determined by the width at which the device has maximum $C_{max}/C_{min}$ and minimal loss tangent.

A controllable voltage source 24 is connected by lines 26 and 28 to electrodes 18 and 20. This voltage source is used to supply a DC bias voltage to the ferroelectric layer, thereby controlling the permittivity of the layer. The varactor also includes an RF input 30 and an RF output 32. The RF input and output are connected to electrodes 18 and 20, respectively, by soldered or bonded connections.

In the preferred embodiments, the varactors may use gap widths of less than 5–50 $\mu$m. The thickness of the ferroelectric layer ranges from about 0.1 $\mu$m to about 20 $\mu$m. A sealant 34 is positioned within the gap and can be any non-conducting material with a high dielectric breakdown strength to allow the application of high voltage without arcing across the gap. In the preferred embodiment, the sealant can be epoxy or polyurethane.

The other dimension that strongly influences the design of the varactors is the length, L, of the gap as shown in FIG. 1. The length of the gap L can be adjusted by changing the length of the ends 36 and 38 of the electrodes. Variations in the length have a strong effect on the capacitance of the varactor. The gap length will optimized for this parameter. Once the gap width has been selected, the capacitance becomes a linear function of the length L. For a desired capacitance, the length L can be determined experimentally, or through computer simulation.

The thickness of the tunable ferroelectric layer also has a strong effect on the $C_{max}/C_{min}$. The optimum thickness of the ferroelectric layers will be determined by the thickness at which the maximum $C_{max}/C_{min}$ occurs. The ferroelectric layer of the varactor of FIGS. 1 and 2 can be comprised of a thin film, thick film, or bulk ferroelectric material such as Barium-Strontium Titanate, $Ba_xSr_{1-x}TiO_3$ (BSTO), BSTO and various oxides, or a BSTO composite with various dopant materials added. All of these materials exhibit a low loss tangent. For the purposes of this description, for operation at frequencies ranging from about 1.0 GHz to about 10 GHz, the loss tangent would range from about 0.0001 to about 0.001. For operation at frequencies ranging from about 10 GHz to about 20 GHz, the loss tangent would range from about 0.001 to about 0.01. For operation at frequencies ranging from about 20 GHz to about 30 GHz, the loss tangent would range from about 0.005 to about 0.02.

The electrodes may be fabricated in any geometry or shape containing a gap of predetermined width. The required current for manipulation of the capacitance of the varactors disclosed in this invention is typically less than 1 $\mu$A. In the preferred embodiment, the electrode material is gold. However, other conductors such as copper, silver or aluminum, may also be used. Gold is resistant to corrosion and can be readily bonded to the RF input and output. Copper provides high conductivity, and would typically be coated with gold for bonding or nickel for soldering.

FIGS. 1 and 2 show a voltage tunable planar varactor having a planar electrode with a predetermined gap distance on a single layer tunable bulk, thick film or thin film dielectric. The applied voltage produces an electric field across the gap of the tunable dielectric that produces an overall change in the capacitance of the varactor. The width of the gap can range from 5 to 50 $\mu$m depending on the performance requirements. The varactor can be in turn integrated into a myriad of tunable devices such as those commonly used in conjunction with semiconductor varactors.

Figure 3A:
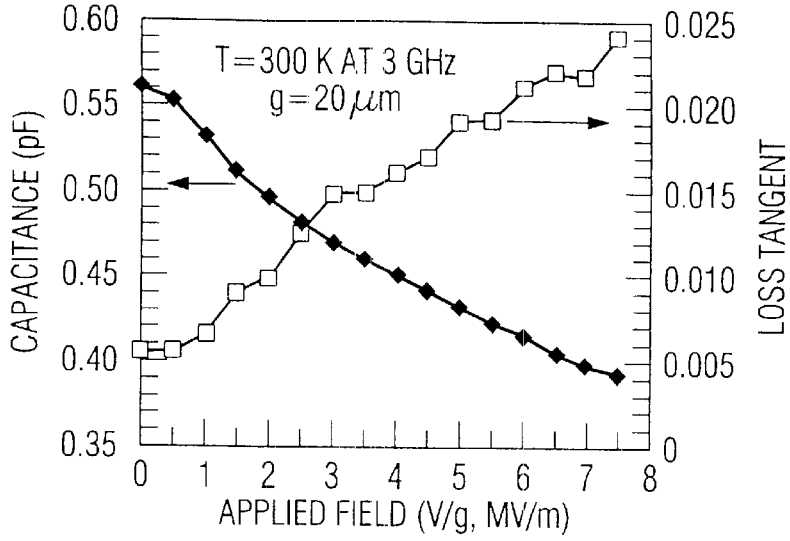
FIGS. 3*a*, 3*b* and 3*c* are graphs illustrating the capacitance and loss tangent of voltage tunable varactors constructed in accordance with this invention at various operating frequencies and gap widths.
Figure 3B:
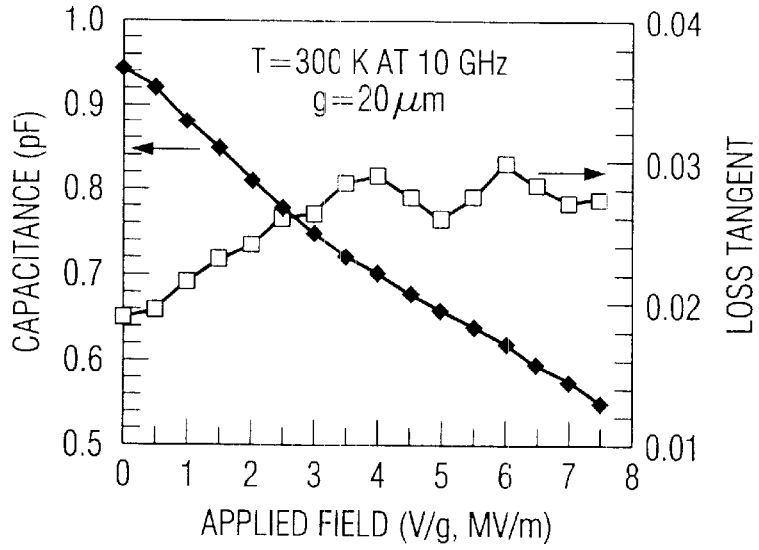
Figure 3C:
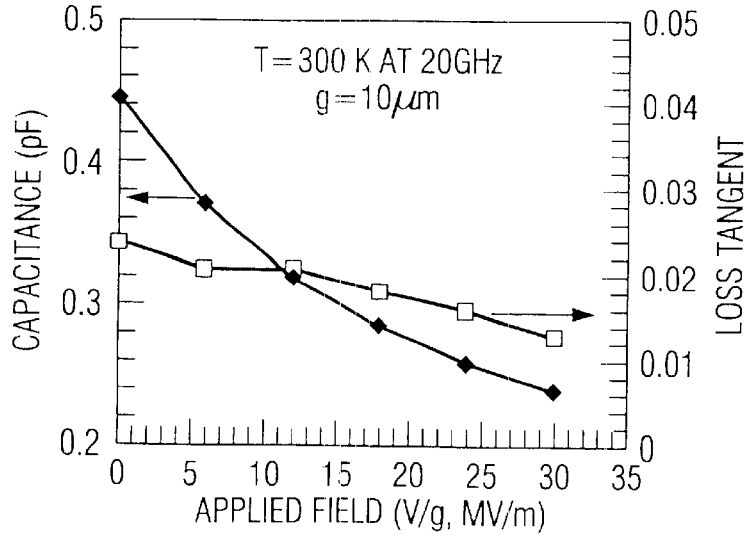

The preferred embodiments of voltage tunable dielectric varactors of this invention have Q factors ranging from about 50 to about 10,000 when operated at frequencies ranging from about 1 GHz to about 40 GHz. The capacitance (in pF) and the loss factor (tan $\delta$) of the varactors measured at 3, 10 and 20 GHz for gap distances of 10 and 20 $\mu$m are shown in FIGS. 3*a*, 3*b* and 3*c*. Based on the data shown in FIGS. 3*a*, 3*b* and 3*c*, the Q's for the varactors are approximately the following: 200 at 3 GHz, 80 at 10 GHz, 45–55 at 20 GHz. In comparison, typical Q's for GaAs semiconductor diode varactors are as follows: 175 at 2 GHz, 35 at 10 GHz and much less at even higher frequency. Therefore at frequencies greater than or equal to 10 GHz the varactors of this invention have much better Q factors.

Figure 4:
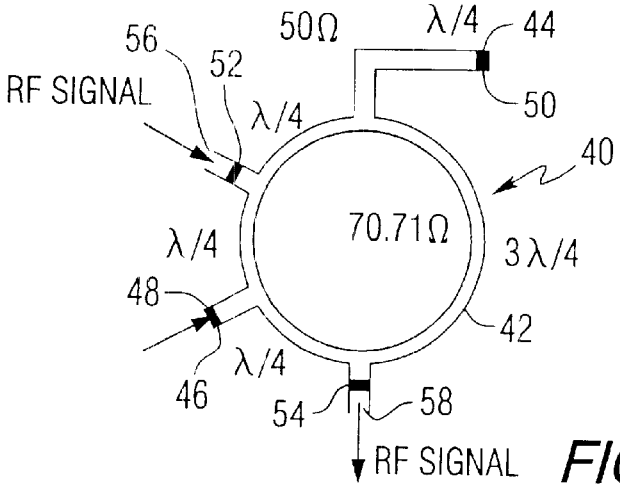
FIG. 4 is a top plan view of an analog reflective termination phase shifter with a rat-race hybrid coupler, which includes varactors constructed in accordance with the present invention.

FIG. 4 shows a top view of a phase shifter 40 having varactors constructed in accordance with the invention for use in the operating range of 1.8 to 1.9 GHz. The phase shifter 40 includes a rat-race coupler 42, two reflective terminations 44, 46 and a bias circuit connected to the varactors as shown in FIG. 1, but not shown in FIG. 4. Each of the reflective terminations includes a series combination of a ferroelectric varactor of FIGS. 1 and 2, and an inductor 48, 50. Two DC blocks 52 and 54 are mounted on the arms of the input 56 and output 58 of the rat race coupler respectively. The DC blocks may be constructed in accordance with know techniques, such as by using a surface mounted capacitor with high capacitance or a distribution passband filter.

Figure 5:
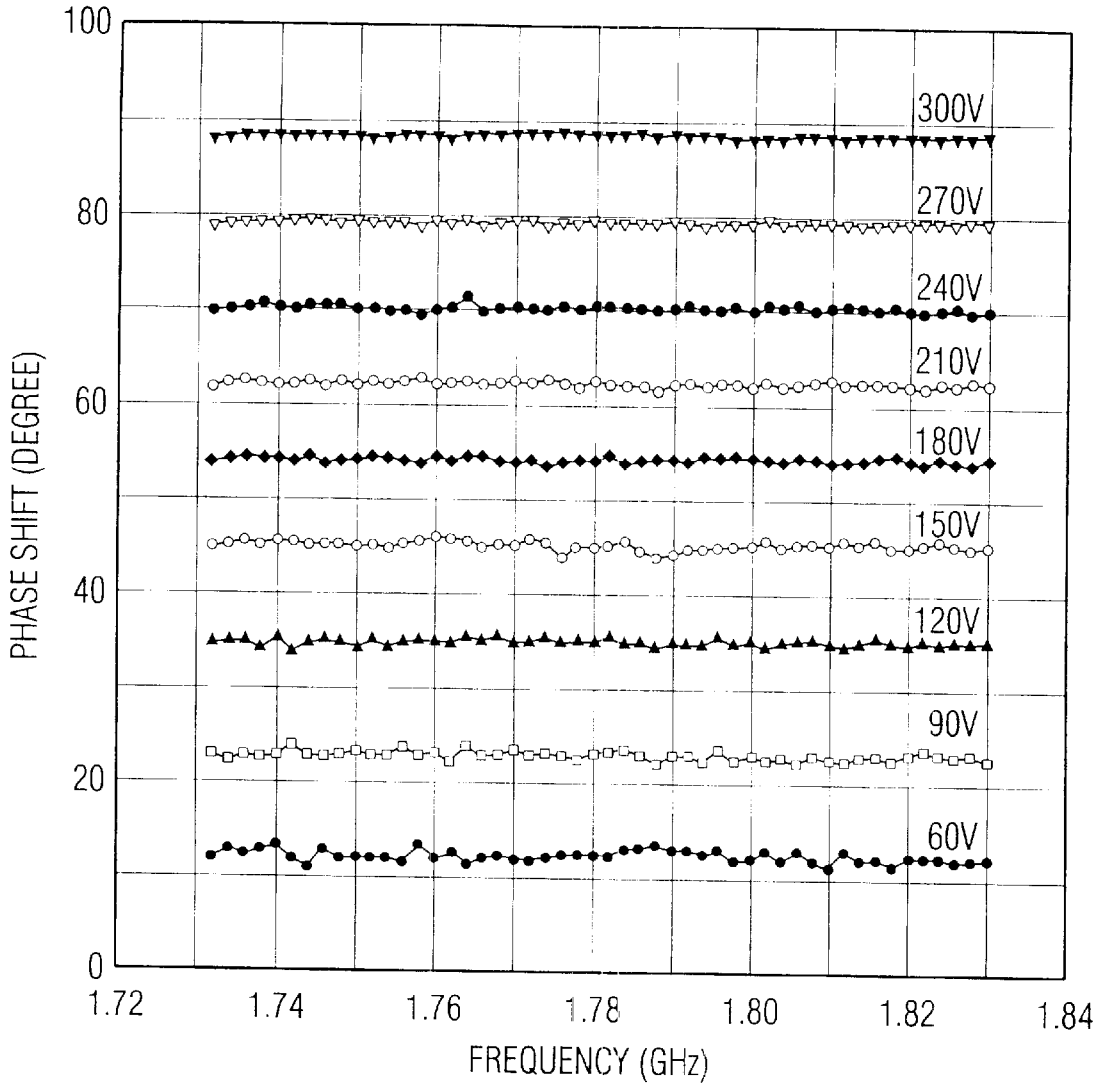
FIG. 5 is a graph illustrating phase shift produced by the phase shifter of FIG. 4 at various frequencies and bias voltages.

Experimental results for the phase shifter of FIG. 4 were achieved as shown in FIG. 5, in the range of the applied varactor bias voltage of 0 to 300 volts DC. The figure of merit is about 110, with a relative phase shift error less than 3% over a frequency range of 1.8 to 1.9 GHz. The insertion loss of the phase shifter is about 1.0 dB, which includes 0.5 dB related to mismatching and losses in the metal films. The operation temperature of the device was 300° K.

Figure 7:
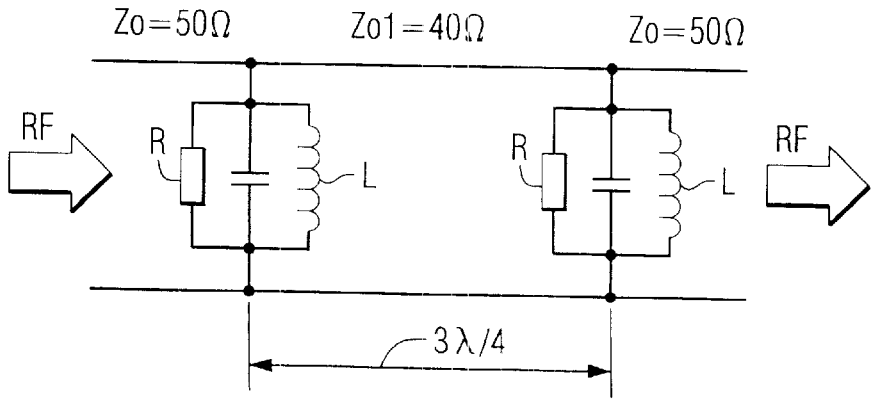
FIG. 7 is an equivalent circuit representation of the phase shifter of FIG. 7.
Figure 6:
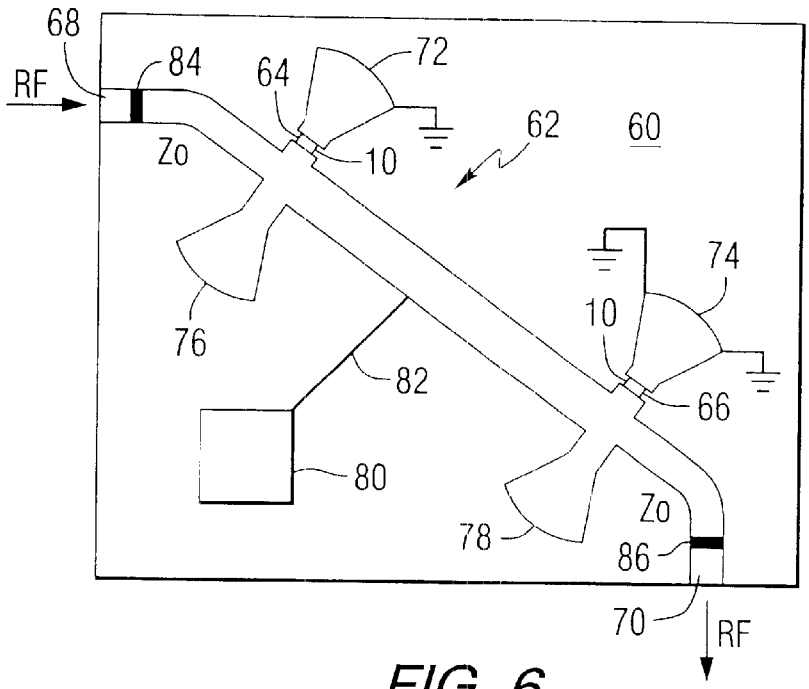
FIG. 6 is a top plan view of a loaded line circuit phase shifter with a planar varactor constructed in accordance with the present invention.
Figure 8A:
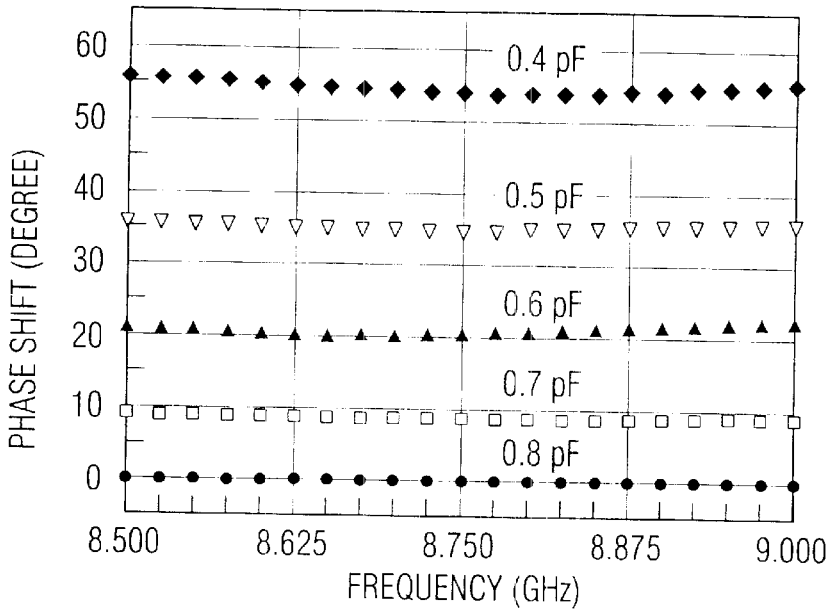
FIGS. 8*a*, 8*b* and 8*c* are graphs illustrating simulated performance data for the loaded line phase shifter of FIG. 6.
Figure 8B:
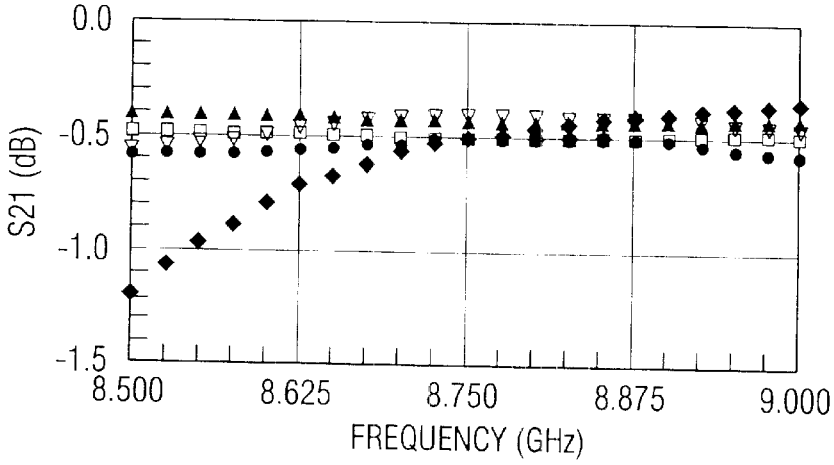
Figure 8C:
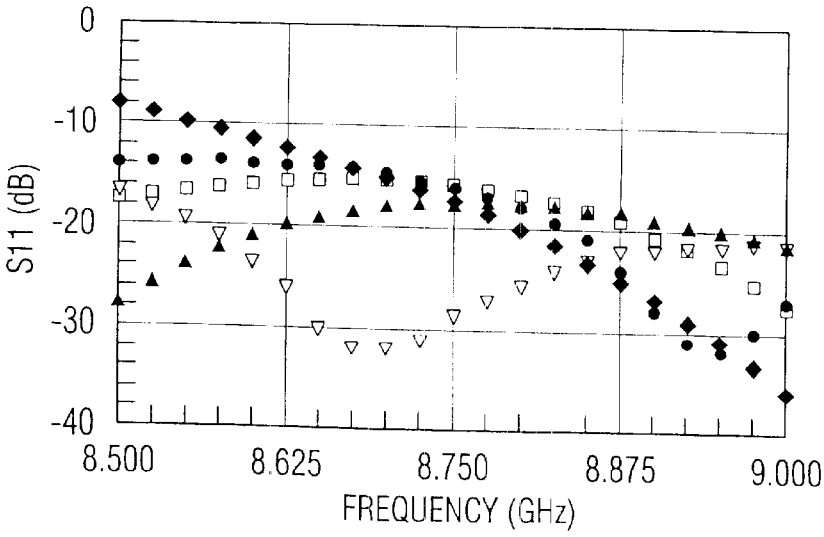

FIG. 6 is a top view of a 10 GHz phase shifter 60 based on a loaded line 62 microstrip circuit. Two planar ferroelectric varactors 10 are incorporated in the gaps 64, 66 of the line 62. An RF signal is input and output by way of 50-ohm microstrips 68 and 70 respectively. The center microstrip has a 40-ohm impedance in this example. Quarter-wave radial stubs 72, 74, 76 and 78 are used as impedance matching. The varactors are tuned by the DC bias applied through contact pad 80 and wire 82. Two DC blocks 84 and 86 are similar to those discussed in FIG. 4. The equivalent circuit of the phase shifter of FIG. 6, without the DC blocks, is shown in FIG. 7. Calculated values of the insertion loss (S21), reflection coefficient (S11) and phase shift ($\Delta\phi$) of the device for varactor capacitances ranging from 0.4 pF to 0.8 pF, are shown in FIGS. 8*a*, 8*b* and 8*c*. The figure of merit for the phase shifter of FIG. 6 is 180 deg/dB over a frequency range of about 0.5 GHz. This device is appropriate for applications where the phase shift requirements are less than 100 degrees.

Figure 9:
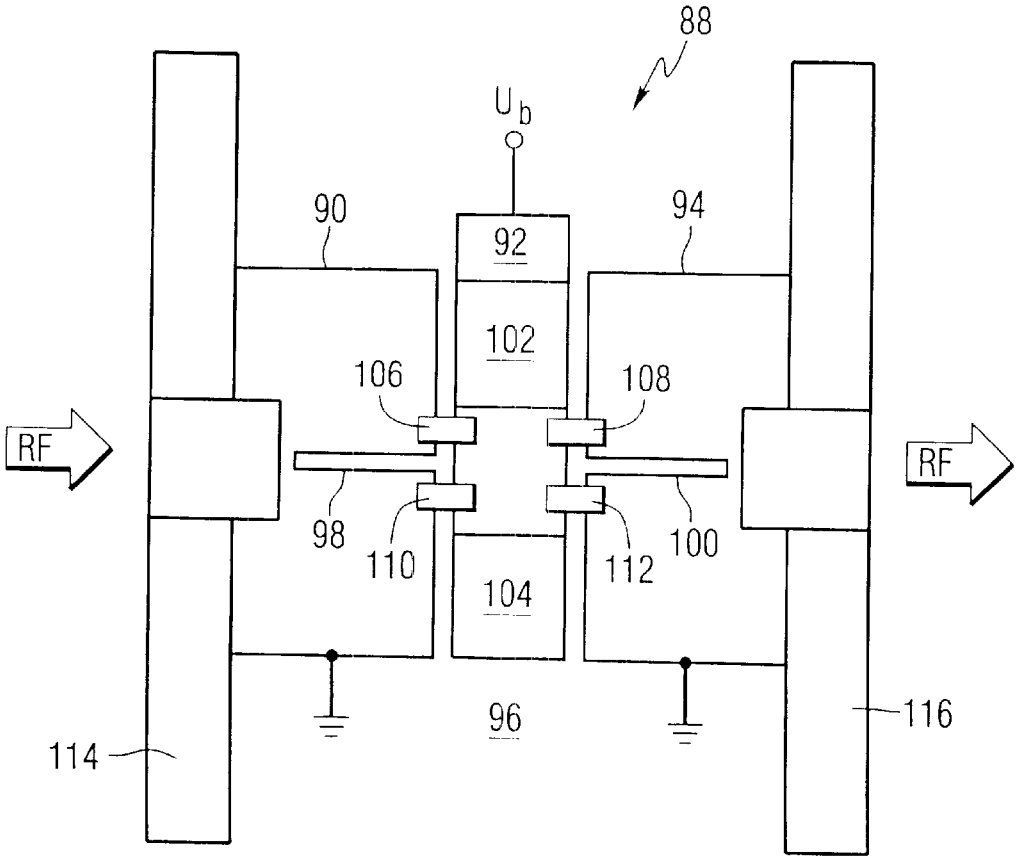
FIG. 9 is a top view of a fin-line waveguide tunable filter with planar varactors constructed in accordance with the present invention.
Figure 10:
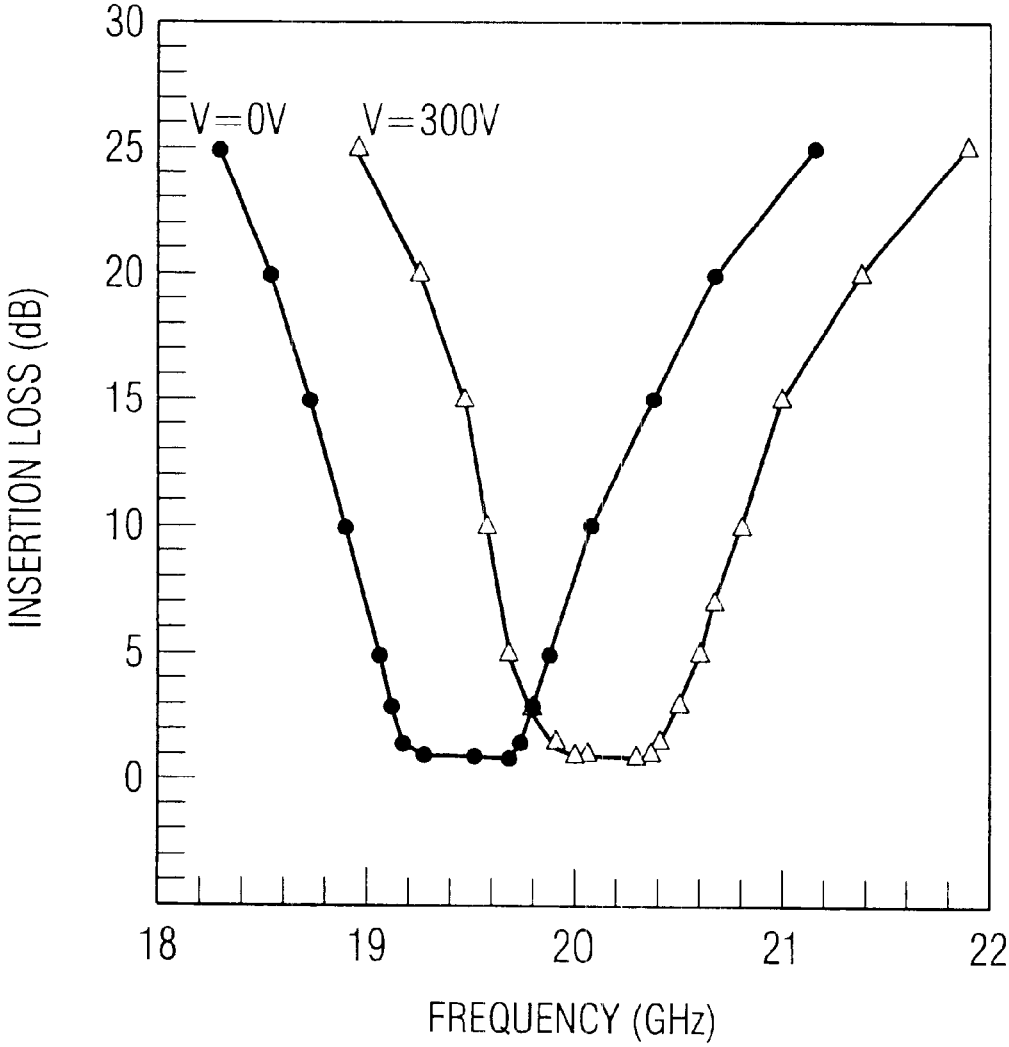
FIG. 10 is a graph illustrating measured data for the fin line tunable filter of FIG. 9.

FIG. 9 is a top view of a tunable filter 88 with four ferroelectric varactors based on a symmetrical fin line in a rectangular waveguide. In this embodiment of the invention, an electrically tunable filter is achieved at room temperature by mounting several ferroelectric varactors on a fin line waveguide. The fin line construction is comprised of three foil copper plates 90, 92 and 94 with thickness of 0.2 mm placed at the center of the waveguide 96 along its longitudinal axis. Two lateral plates with shorted end fin line resonators 98 and 100 are grounded due to the contact with the waveguide. Central plate 92 is insulated for DC voltage from the waveguide by mica 102 and 104 and is used to apply the control voltage ($U_b$) to the tunable dielectric varactors 106, 108, 110 and 112. The tunable ferroelectric varactors are soldered in the end of the fin line resonators between plates 90 and 92, and plates 94 and 92. Flanges 114 and 116 support the plates. The frequency response of the filter of FIG. 9 is shown in FIG. 10. In the frequency range of the tuning $\Delta F$~0.8 GHz (~4%) the filter demonstrates the insertion losses ($L_0$) not more than 0.9 dB and the bandwidth of $\Delta f/f$~2.0% at the level of $L_0$, The reflection coefficient for the central frequency was not more than −20 dB for any point of the tuning range. The number of bands $\Delta f$ of the filter which are contained in the frequency range of the tuning $\Delta F$ was about $\Delta F/\Delta f=2$. Note that for higher bias voltages more tuning of the filter is possible.

By utilizing the unique application of low loss (tan $\delta<0.02$) dielectrics of predetermined dimensions, this invention provides a high frequency high power varactor that surpasses the high frequency (>3 GHz) performance of the semiconductor varactors. The utilization of these varactors into tunable devices is also realized in this invention. Several examples of specific applications of the varactors in phase shifters and a tunable filter have been described. This invention has many practical applications and many other modifications of the disclosed devices may be obvious to those skilled in the art without departing from the spirit and scope of this invention. In addition, the tunable dielectric varactors of this invention have increased RF power handling capability and reduced power consumption and cost.

The invention provides voltage tunable bulk, thick film, and thin film varactors that can be used in room temperature voltage tunable devices such as filters, phase shifters, voltage controlled oscillators, delay lines, and tunable resonators, or any combination thereof. Examples are provided for varactors, fin line tunable filters and phase shifters. The fin line filter is comprised of two or more varactors and is based on a symmetrical fin line in a rectangular waveguide. The example phase shifters contain reflective terminations with hybrid couplers and a loaded line circuit with planar varactor incorporation. The example phase shifters can operate at frequencies of 2, 10, 20, and 30 GHz.

While the present invention has been described in terms of what are at present its preferred embodiments, various modifications of such embodiments can be made without departing from the scope of the invention, which is defined by the claims.

What is claimed is:

1. A tunable fin line filter comprising:

a rectangular waveguide;

three conductive plates positioned along a longitudinal axis of the waveguide, wherein one of said conductive plates is insulated from said waveguide;

two lateral plates having shorted end fin line resonators and being grounded to the waveguide;

plurality of varactors, one of said varactors being electrically coupled to each of fin-line resonator;

wherein the tunable varactor includes a substrate having a first dielectric constant and having generally planar surface, a tunable ferroelectric layer including a tunable component and a non-tunable component and being positioned on the generally planar surface of the substrate, the tunable ferroelectric layer having a second dielectric constant greater than said first dielectric constant, and first and second electrodes positioned on a surface of the tunable ferroelectric layer opposite the generally planar surface of the substrate, said first and second electrodes being separated to form a gap therebetween, said voltage tunable dielectric varactor having a Q factor from about 50 to about 10,000 when operated at frequencies ranging from about 1 GHz to about 40 GHz.

2. A tunable fin line filter as recited in claim 1, wherein the tunable ferroelectric layer has a permittivity greater than 100.

3. A tunable fin line phase shifter as recited in claim 1, wherein the substrate has a permittivity of less than 30.

4. A tunable fin line filter as recited in claim 1, wherein the tunable ferroelectric layer comprises at least one composite selected from the group of: BSTO—MgO, BSTO—MgAl2O4, BSTO—CaTiO3, BSTO—MgTiO3, and BSTO—MgSrZrTiO6.

5. A voltage tunable dielectric varactor comprising:

a substrate having a first dielectric constant and having generally a planar surface;

a tunable ferroelectric layer, wherein the tunable ferroelectric layer has a permittivity in a range from 20 to 2000, and a tunability in a range from about 10% to about 80% at a bias voltage of about 10 V/$\mu$m, and being positioned on the generally planar surface of the substrate, the tunable ferroelectric layer having a second dielectric constant greater than said first dielectric constant; and first and second electrodes positioned on a surface of the tunable ferroelectric layer opposite the generally planar surface of the substrate, said first and second electrodes being separated to form a gap therebetween, said voltage tunable dielectric varactor having a Q factor from about 50 to about 10,000 when operated at frequencies ranging from about 1 GHz to about 40 GHz.

6. A voltage tunable dielectric varactor as recited in claim 5, further comprising:

an insulating material in said gap.

7. A voltage tunable dielectric varactor as recited in claim 5, wherein the substrate comprises one of the group of: MgO, Alumina, LaAlO3, sapphire, and a ceramic.

8. A voltage tunable dielectric varactor as recited in claim 5, wherein the tunable ferroelectric layer comprises one of:

a tunable ferroelectric thick film;

a tunable ferroelectric bulk ceramic; and a tunable ferroelectric thin film.

9. A voltage tunable dielectric varactor as recited in claim 5, further comprising:

an RF input and an RF output for passing an RF signal through the tunable ferroelectric layer in a first direction, and wherein the gap extends in a second direction substantially perpendicular to the first direction.

* * * * *